United States Patent [19]

May

[11] Patent Number: 4,540,010

[45] Date of Patent: Sep. 10, 1985

[54] PORTABLE KNOCK-DOWN CANOPY

[76] Inventor: Jim May, 12110 SE. Pine, Portland, Oreg. 97216

[21] Appl. No.: 569,904

[22] Filed: Jan. 11, 1984

[51] Int. Cl.[3] ..... A45F 1/00

[52] U.S. Cl. ..... 135/99; 135/DIG. 9

[58] Field of Search ..... 135/98, 99, 101, 106, 135/107, 108, 109, 115, 117, 120, DIG. 9, 87, 90; 403/385, 391, 400, 205, 191, 233, 235, 236

[56] References Cited

U.S. PATENT DOCUMENTS

| | | | |
|---|---|---|---|
| 335,115 | 2/1886 | Dillenbeck et al. | 135/99 X |
| 1,018,522 | 2/1912 | Savage | 135/99 X |
| 1,653,822 | 12/1927 | Pliskin | 135/106 |
| 3,462,021 | 8/1969 | Hawke et al. | 403/233 X |
| 4,066,371 | 1/1978 | Chapman | 403/391 X |
| 4,338,040 | 7/1982 | Hawkins | 403/400 X |

FOREIGN PATENT DOCUMENTS

| | | | |
|---|---|---|---|
| 816150 | 10/1951 | Fed. Rep. of Germany | 403/191 |
| 1026188 | 2/1953 | France | 403/391 |
| 64546 | 11/1968 | German Democratic Rep. | 135/106 |

*Primary Examiner*—Robert A. Hafer
*Assistant Examiner*—Arnold W. Kramer
*Attorney, Agent, or Firm*—Eugene M. Eckelman

[57] ABSTRACT

A support post is arranged to support a first horizontal bar and a second horizontal bar at right angles to the first bar. Third and fourth bars are supported on the ends of the second bar in parallel relation with the first bar. Two forms of brackets are provided to interconnect the various bars, one form of the brackets supporting the second bar and the other form supporting the first and third and fourth bars. A removable cover extends over the first bar and is tied to the third and fourth bars.

3 Claims, 4 Drawing Figures

PORTABLE KNOCK-DOWN CANOPY

BACKGROUND OF THE INVENTION

This invention relates to new and useful improvements in canopies and particularly pertains to a portable, knock-down canopy.

Various types of canopies, umbrellas, or other shelters have been utilized to provide protection from the weather. Such prior structures utilize custom-built parts having direct connected association providing for their construction and also in some cases, such as the umbrella type, have an association which does not facilitate disassembly for knock-down construction and dismantling. Such prior structures are bulky in shipment and storage, and also some are costly to manufacture and time consuming to erect.

SUMMARY OF THE INVENTION

According to the present invention and forming a primary objective thereof, a portable knock-down canopy is provided which employs four basic manufactured brackets, the other elements of the canopy being readily available on the market whereby for commercial utilization of the invention, it is merely necessary to supply the brackets for outlets to the customer and the customer can obtain other elements at readily available sources, thus minimizing costs of shipment and storage and also allowing the customer to use materials that are on hand.

In carrying out the objectives of the invention, the canopy comprises four brackets which in assembly of the canopy are associated with a support post, a first horizontal bar supported on the post, a second horizontal bar also supported on the post and disposed at right angles to the first horizontal bar in a lower plane, third and fourth horizontal bars supported on the second bar in parallel relation to the first bar, and a flexible cover draped over the first bar and tied to the third and fourth bars. The four brackets have removable connection to the post and the various bars, with some of the connections being slidable to provide for the erection and adjustment of the various parts. All of the parts except the brackets are readily available on the market.

The invention will be better understood and additional objects and advantages will become apparent from the following description taken in connection with the accompanying drawings.

DETAILED DESCRIPTION OF A PREFERRED EMBODIMENT

Figure 1:
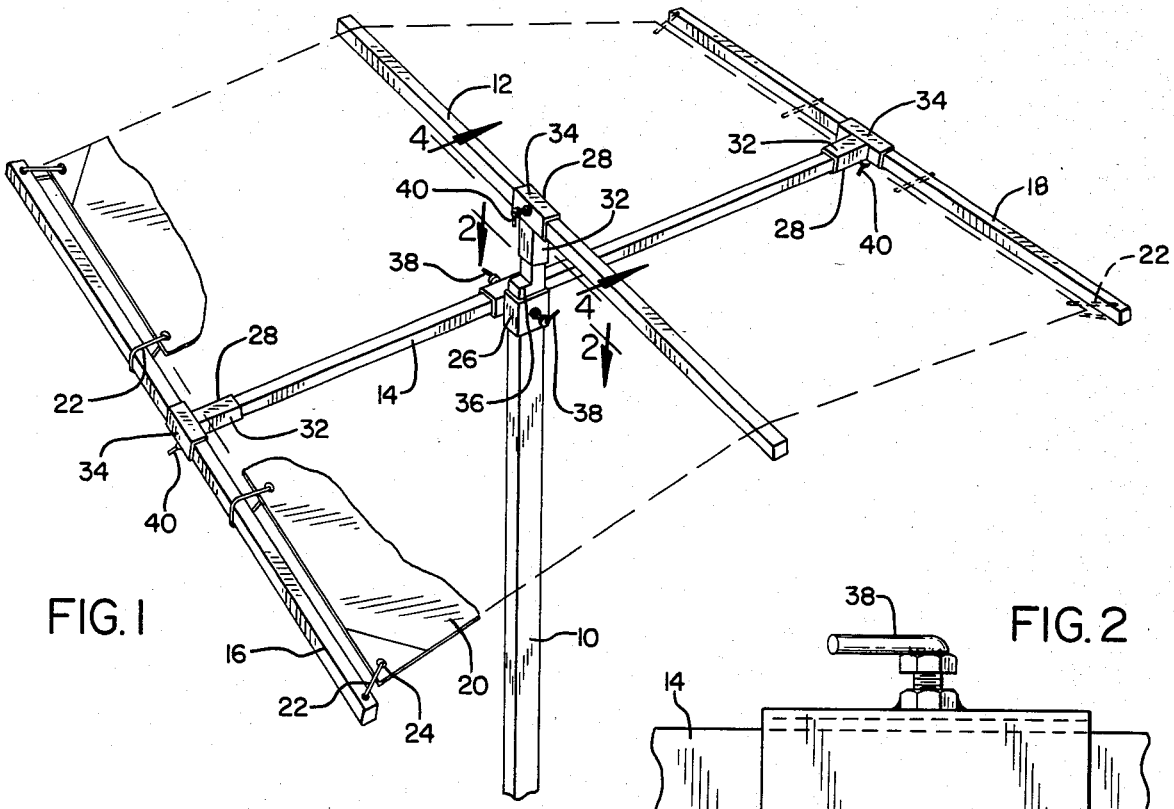
FIG. 1 is a perspective view of the present portable knock-down canopy as set up for use.

With particular reference to the drawings, the canopy of the invention when set up for use comprises a support post 10, a first horizontal bar 12 supported at the top of the post 10 and forming a ridge member, a second horizontal bar 14 supported on the post below the top thereof at right angles to the first bar, and third and fourth bars 16 and 18, respectively, supported on the ends of the bar 14 in parallel relation with the central bar 12 and forming side supports. In the constructed condition of the canopy, the bar 12 forms the central support for a flexible cover or roof 20 having ties 22 connected to the side bars 16 and 18. Ties 22 may be provided at the corners and also along the length of the side bars as desired.

The parts thus far described are readily available on the market. That is, the post 10 and the bars 12, 14, 16 and 18 may comprise 2×2's, 2×3's, or other available lumber pieces. The flexible cover 20 comprises a tarp, such as a plastic or canvas tarp, which is readily available on the market and which already has suitable grommets 24 arranged to receive the ties 22.

Figure 2:
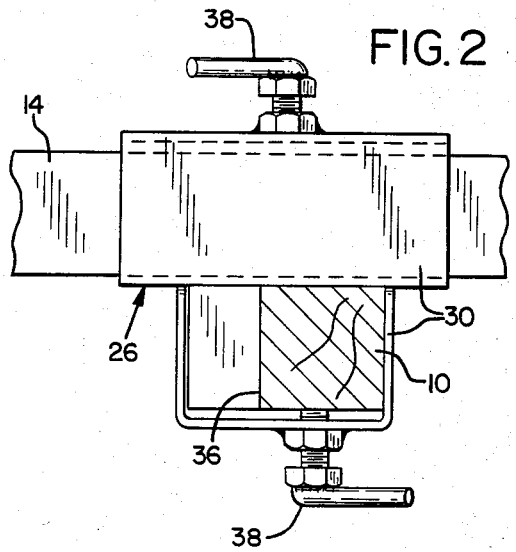
FIG. 2 is a sectional view taken on the line 2—2 of FIG. 1 and showing one form of bracket used with the canopy.
Figure 4:
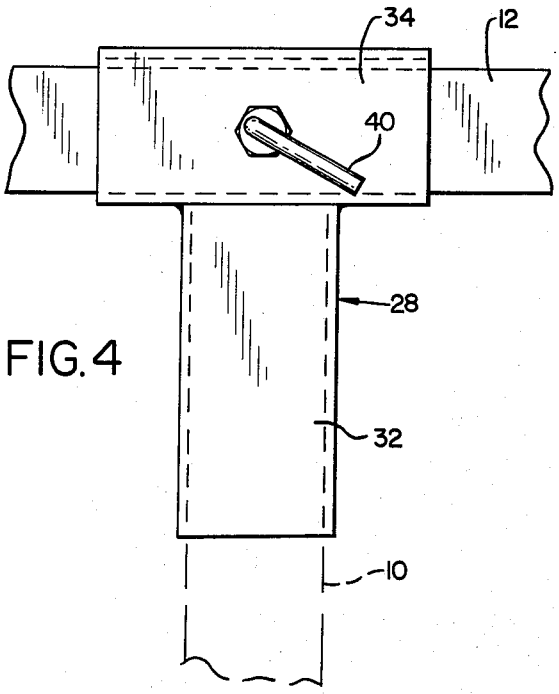
FIG. 4 is an elevational view of another form of bracket used with the canopy, this view being taken on the line 4—4 of FIG. 1.
Figure 3:
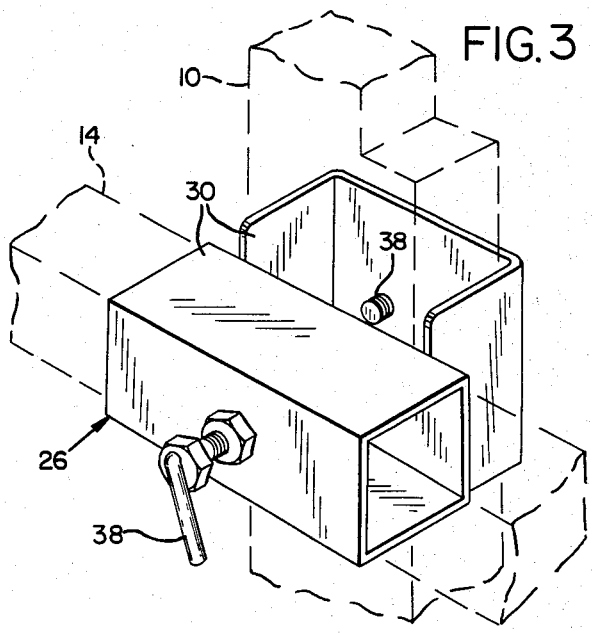
FIG. 3 is a perspective view of the bracket of FIG. 2.

Assembly of the cover is accomplished by four brackets comprising a first bracket 26, FIGS. 1–3, which is supported on the post 10 intermediate the ends thereof, and three other brackets 28, FIGS. 1 and 4, which are of identical structure and which support the bars 12, 16 and 18.

The bracket 26 comprises a pair of integrated tubular portions 30 disposed at right angles to each other. These tubular portions are open at their ends, with one of them being vertically disposed to receive the post 10 and the other being horizontally disposed to receive the cross bar 14. The brackets 28 comprise a socket or recess portion 32 and an open-ended tubular portion 34 integrated with one end of the portion 32 in right angle relationship. The socket portion 32 of one of the brackets 28 receives the top end of the post 10 and the tubular portion 34 thereof receives the horizontal bar or ridge member 12. The socket portions 32 of the other two brackets 28 receive the respective ends of the cross bar 14 and the tubular portions 34 receive the side bars 16 and 18. The top of the post on the ends of the bar 14 may be notched as necessary, such as illustrated by the numeral 36 in FIGS. 1 and 2, in the event enlarged frame members need to be fitted to the bracket 26.

The tubular portions 30 of the bracket 26 have set screws 38 therein arranged to secure this bracket in a selected vertically adjusted position on the post and also to anchor the bar 14 against longitudinal movement relative to the post. Set screws 40 also are preferably utilized in the tubular portions 34 of the brackets 28 to anchor the bars in a fixed position in the brackets. The bracket 26 is pulled down on the post during assembly to tighten the cover 20, and by fixing this bracket 26 in place by its setscrew 38, the cover holds the brackets 28 securely on the bar 14.

To assemble the present canopy, it is merely necessary to fit the various bars and the center posts in the respective brackets and to tie the cover 20 across the top to the bars 16 and 18. This is accomplished with the bracket 26 disposed upwardly on the post such that the cover is in loosened condition. As a final step, the bracket 26 is pulled down to tighten the cover and then fixed in place by means of its setscrew 38. The post 10 may be suitably mounted or anchored at the bottom end to a support for holding it in upright relation. As apparent, the canopy is easily disassembled.

Thus, a canopy is provided that can be easily erected and dismantled and uses as the most bulky portions thereof parts that are either available or readily available from other sources by the user. Of course, all the parts, including the frame parts, may be bundled into one package for commercial outlet but if desired the only parts required to be packaged and shipped for commercial outlet are the four brackets.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A portable knock-down canopy comprising a vertical support post having upper and lower ends arranged to be secured at its lower end to a supporting surface, a first horizontal bar, a first bracket having a socket portion removably receiving the top end of said post and also having a tubular open ended portion disposed at right angles to said socket portion and removably receiving said first bar, a second horizontal bar having opposite ends, a second bracket having a pair of tubular portions disposed at right angles to each other and removably receiving respectively the second bar and said post, the tubular portion of said second bracket that receives said support post having securing means therein for adjustably securing said second bracket vertically on said post below the upper end thereof, third and fourth horizontal bars having opposite ends, third and fourth brackets each having a socket portion receiving respectively opposite ends of said second bar and also having a tubular open ended portion disposed at right angles to said socket portion of its bracket receiving respectively the third and fourth bars and supporting the latter in parallel relation to said first bar but therebelow, and a flexible cover removably secured to said third and fourth bars in draped relation over said first bar, said cover being tightened in its draped relation over said first bar by lowered adjusting securement of said second bar on said post and in being lowered, said cover is tensioned to pull said third and fourth bars toward each other and hold the socket portions of the respective third and fourth brackets on the ends of said second bar.

2. The portable knock-down canopy of claim 1 including securing means in said tubular open ended portion of said first bracket for adjustably positioning said first bar longitudinally in said first bracket and securing means in said tubular open ended portion of said second bracket for adjustably positioning said second bar longitudinally in said second bracket.

3. A portable knock-down canopy comprising a first bracket having first and second tubular portions disposed at right angles to each other and arranged to removably receive respectively an upright support post and a cross bar, said first tubular portion having securing means therein arranged to adjustably position said first bracket vertically on said upright support post, and three additional identical brackets each having a socket portion and a tubular open ended portion disposed at right angles to said socket portion of its bracket, a first of said additional brackets being arranged to receive the top end of said support post in its socket portion and a ridge bar in its tubular portion which is disposed at right angles to said cross bar, and second and third of said additional brackets arranged to removably receive respective ends of said cross bar in said socket portion thereof for support on said cross bar and to removably receive respective side bars in said tubular portion thereof holding the side bars in parallel relation to the ridge bar and for removably supporting a flexible cover arranged to be draped over the ridge bar and removably secured to the side bars and tightened by lowering said cross bar.

* * * * *